US007234406B2

(12) United States Patent
Antonov et al.

(10) Patent No.: US 7,234,406 B2
(45) Date of Patent: Jun. 26, 2007

(54) FAST SAIL

(76) Inventors: Sergey Antonov, 1240-40 High Park Ave., Toronto (CA) M6P 2S1; Alexei I Antonov, 1604-40 High Park Ave., Toronto (CA) M6P 2S1

( * ) Notice: Subject to any disclaimer, the term of this patent is extended or adjusted under 35 U.S.C. 154(b) by 0 days.

(21) Appl. No.: 11/163,562

(22) Filed: Oct. 23, 2005

(65) Prior Publication Data

US 2006/0236911 A1 Oct. 26, 2006

Related U.S. Application Data

(60) Provisional application No. 60/594,621, filed on Apr. 24, 2005.

(51) Int. Cl.
*B63H 9/04* (2006.01)
*B63B 35/00* (2006.01)

(52) U.S. Cl. ..... 114/102.1; 114/39.11

(58) Field of Classification Search .. 114/39.11–39.13, 114/39.21–39.22, 39.29, 39.32, 102.1, 102.12, 114/102.13–102.18, 102.3, 102.22, 102.27, 114/102.29

See application file for complete search history.

(56) References Cited

U.S. PATENT DOCUMENTS

| | | | | |
|---|---|---|---|---|
| 1,670,936 | A * | 5/1928 | McIntyre et al. | 114/39.29 |
| 4,604,959 | A * | 8/1986 | Menear | 114/39.13 |
| 4,799,443 | A * | 1/1989 | Vogel | 114/39.29 |
| 6,189,472 | B1 * | 2/2001 | Duncan | 114/102.16 |

FOREIGN PATENT DOCUMENTS

| | | | |
|---|---|---|---|
| FR | 2630993 | A2 * | 11/1989 |
| FR | 2700745 | A1 * | 7/1994 |

* cited by examiner

*Primary Examiner*—Jesús D. Sotelo

(57) ABSTRACT

This invention belongs to the field of wind propelled vehicles. The goal of the invention is to provide large sails creating no overturning force. This is achieved by placing the top part of the sail above the vehicle and the bottom part of the sail aside from the vehicle.

4 Claims, 1 Drawing Sheet

FAST SAIL

This invention aims to increase the speed of the sailboat or other sail carrying vehicle. There are two speed limitation factors: the size of the sails and overturning force inflicted by the sails of the vehicle. This invention provides method and apparatus for carrying the sail solving both problems. Positioning of the sail at an angle to vertical and aside from the longitudinal axis of the vehicle, results in great reduction of overturning force. The invention explains how to set sails which are much larger than conventional ones, while keeping the overturning force very low.

BACKGROUND OF THE INVENTION

This invention belongs to the field of wind propelled vehicles in general and sailboats in particular. It is well known, that increased sail area allows sailboats to reach higher speed. It is also well known, that increased sail area produces higher overturning force. Sailboats are designed to withstand high overturning force allowing to carry large sails and, therefore, to reach high speed. Sailboats have broad hulls and ballast or multiple hulls to achieve high speed. It is also known, that overturning force increases as wind speed increases, while the ability of the sailboat to withstand that force remains largely the same. This leads to practice of reducing sail area, when wind grows stronger, called "reefing the sails".

Attempts have been made to provide means suitable to counteract overturning force. Thus for example, U.S. Pat. No. 4,703,708 discloses "Steerable Keel" capable of producing counteracting force growing when the speed of the sailboat is rising. In another example, U.S. Pat. No. 4,843,987 discloses "Heel Counteracting Airfoil" capable of producing counteracting force growing when the speed of the wind is rising. However, both examples involve considerable complexity of construction as well as additional resistance to the movement of the sailboat caused by additional airfoil or hydrofoil.

Attempt has been made to provide sails having little or no overturning force. Thus for example, U.S. Pat. No. 5,088,431 discloses two-hull sailboat where sails set at an angle to vertical, specifically top of the sail attached to the mast on the first hull and the bottom of the sail attached to the second hull. For every distance between the hulls, there is the height of the mast such, that the sail creates little overturning force. However, area of that sail is defined and limited by the dimensions of the sailboat.

There is a need for large sail area creating no overturning force.

BRIEF DESCRIPTION OF THE DRAWINGS

On FIG. 1 there is a main view of the proposed apparatus showing two sails 1 and 2, a mast 3 and four poles 4, 5, 6 and 7 set on the sailboat. The sails are positioned symmetrically relatively to the vertical mast.

On FIG. 2 there is a partial view of the proposed apparatus showing a mast 3, four poles 4, 5, 6 and 7 and seven spars 8, 9, 10, 11, 12, 13, 14.

DETAILED DESCRIPTION OF THE INVENTION

Figure 1:
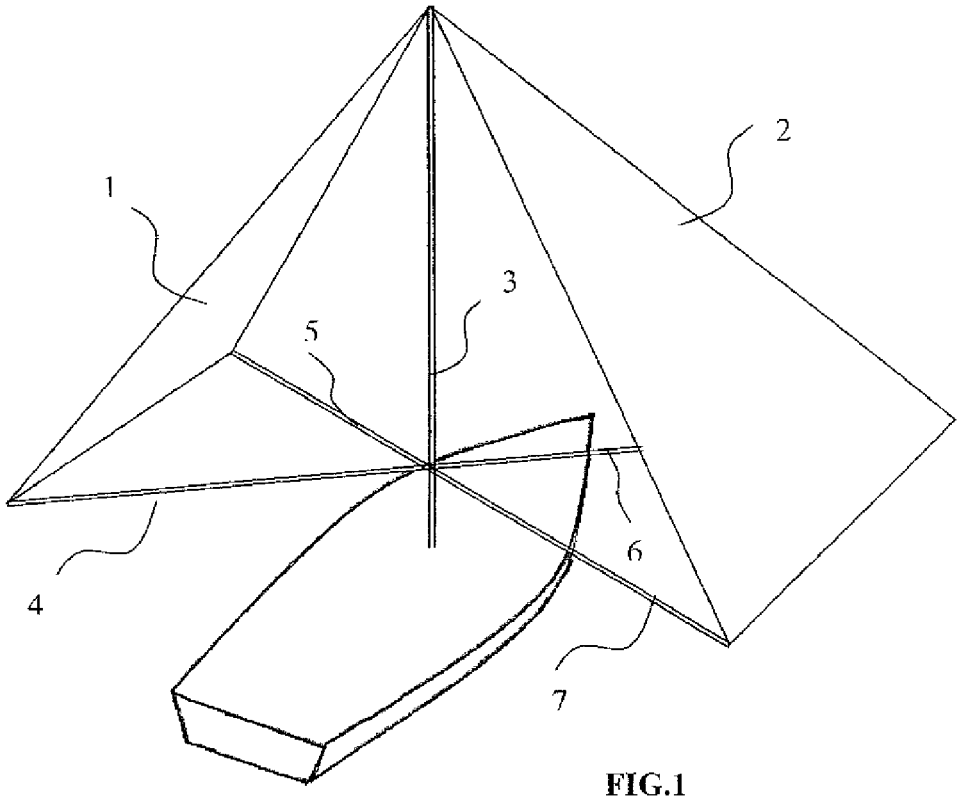
Figure 2:
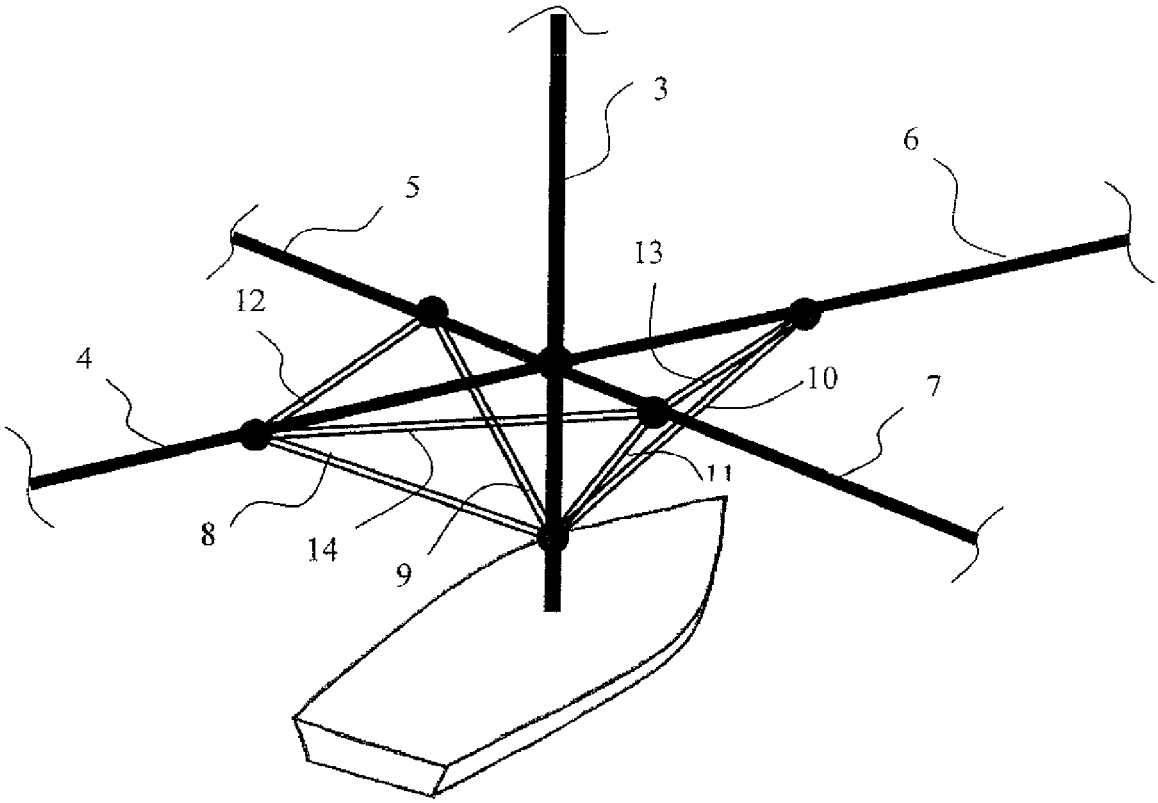

The proposed apparatus comprises rigging carrying two sails 1 and 2. The rigging includes one mast 3 and four poles

4, 5, 6 and 7. One end of every pole is pivotally attached to the mast. Every pole is additionally connected to the mast by a rigid spar of adjustable length 8, 9, 10, and 11. The spars keep the poles in horizontal position while allowing them to rotate about the mast. Every pole forms right angle with the mast. There are two opposing triangular sails 1 and 2. Top corner of each sail is attached to the top of the mast 3. The attachment is done by halyard, the same way as conventional triangular sail is attached. The bottom sides of the sails are parallel to each other. Every bottom corner of every sail is attached to free end of a dedicated pole. The attachment is done the same way as conventional flag is attached by means of blocks and ropes. Every two poles attached to the same sail are connected by rigid spar of adjustable length. The spars control the camber or fullness of the sails. Two downwind poles 4 and 7 attached to different sails 1 ad 2 are connected by rigid spar of adjustable length 14. The middle point of this spar is the place to connect the main sheet. The spar keeps both sails at the same angle to the wind or at the same angle of attack. The poles, spars and sails, all rigidly connected, rotate as a whole around the mast. The main sheet controls both sails the same way as conventional single vertical sail with boom is controlled.

The poles may be of about 80% mast height long. The poles may form approximately right angles with the mast as well as with adjacent poles. This will result in the sails positioned at about 45 degrees to water level. Total sail area will be about twice that of a sloop with the same height mast. Effective sail area will be about 140% that of the sloop.

It is essential that sail area may be further increased since invented apparatus creates much less overturning force, than does conventional rigging.

If the mast of the boat has any stays, that might put some limitation on the sails' rotation and control. It comes up to reduction of the sails' rotation angle. In that case some additional sail may be used, as a spinnaker for example.

The optimum characteristics (high boat speed and zero overturning force) are achieved with the sails' angle being around 45 degrees to the vertical. Nevertheless, the proposed apparatus allows changing the sails' set angle and the sails' geometry in order to provide and optimum performance and a possibility of an individual tuning.

Due to simple connection of all the elements the whole apparatus can be conveniently assembled, disassembled and stored on the boat.

The preferred embodiment described here is most suitable for a sailboat. There may be other connection used in order to provide rotation of the sails around the mast, control of this apparatus and ability to assemble—disassemble the sails. Other variants could be with or without the poles as well.

It must be clear to those skilled in the art, that the invention may be applied to other types of vehicles such as land-going ones on wheels, or ice-going ones on skates.

It is also must be clear to those skilled in the art, that the embodiment can vary in number and shape of the sails as well as in number and arrangement of supporting components, still remaining within the scope of the invention.

What is claimed is:

1. Apparatus comprises:

a vertical pole having a free end and a bottom end attached to a wind propelled vehicle;

two horizontal poles having each a free end and an end attached to the vertical pole;

a sail having three corners;

means connecting the corners of the sail to the free ends of the poles, one corner to one free end, so that the corner may be pulled up to the corresponding free end means to rotate the horizontal poles together around an axis of the vertical pole to control an angle of attack of the sail.

2. The apparatus from claim 1 where the sail in working position should be set at the angle of about 45 degrees to the vertical pole and about 45 degrees to the horizontal plane.

3. The apparatus from claim 1 where the angle between the horizontal poles may be adjustable in order to control the camber of the sail.

4. The apparatus from claim 2 including second set of horizontal poles and second sail positioned symmetrically to the first set relatively to the vertical pole.

* * * * *